US010285475B1

(12) United States Patent
Tully, Jr.

(10) Patent No.: US 10,285,475 B1
(45) Date of Patent: May 14, 2019

(54) NECKLACE ADAPTER FOR A WATCH

(71) Applicant: Francis Edward Tully, Jr., Spring Hill, FL (US)

(72) Inventor: Francis Edward Tully, Jr., Spring Hill, FL (US)

( * ) Notice: Subject to any disclaimer, the term of this patent is extended or adjusted under 35 U.S.C. 154(b) by 0 days.

(21) Appl. No.: 15/064,357

(22) Filed: Mar. 8, 2016

Related U.S. Application Data

(60) Provisional application No. 62/131,774, filed on Mar. 11, 2015.

(51) Int. Cl.
*A44C 5/14* (2006.01)
*A44C 15/00* (2006.01)

(52) U.S. Cl.
CPC ..... *A44C 5/147* (2013.01); *A44C 15/001* (2013.01)

(58) Field of Classification Search
CPC ..... A44C 5/2038; A44C 5/2014; A44C 5/14; A44C 5/20; A44C 5/2061; Y10T 24/45293; Y10T 24/13; Y10T 24/1374; Y10T 24/3428; Y10T 24/3902; Y10T 24/4016; Y10T 24/44017; Y10T 24/45319; Y10T 24/4534; Y10T 24/45356; Y10T 24/45387; Y10T 24/45435; Y10T 24/45445; Y10T 24/4578; Y10S 24/906; Y10S 24/58; Y10S 24/59; Y10S 24/60
See application file for complete search history.

(56) References Cited

U.S. PATENT DOCUMENTS 2,624,092 A * 1/1953 Duerr ..... A44C 5/14 224/177
2,731,695 A * 1/1956 Valcourt ..... A44C 5/2038 24/598.5
3,094,754 A * 6/1963 Wayne ..... A44C 5/2038 104/2
3,114,187 A * 12/1963 Wayne ..... A44C 5/2038 24/116 A
3,956,804 A * 5/1976 Gatof ..... A44C 5/2038 24/598.5
4,458,393 A * 7/1984 Pogharian ..... A44C 5/2038 24/601.5
6,725,506 B1 * 4/2004 Anscher ..... A44B 99/00 24/170

(Continued)

*Primary Examiner* — Robert Sandy
*Assistant Examiner* — David M Upchurch
(74) *Attorney, Agent, or Firm* — Stanton IP Law Firm, P.A.; Thomas H. Stanton, Esq.; Joel S. Douglas

(57) ABSTRACT

A necklace adapter for use with a smart watch is described. The necklace adapter generally includes an adapter base for connection to the smart watch and a retainer assembly for releasable attachment to a necklace of a user. The retainer assembly includes a hollow lower stem attached to the adapter base and having a first clasp member and a solid shaft, movably mounted within the lower stem, having a second clasp member. The solid stem and second clasp member are movable from a first closed position forming a closed loop with the first clasp member to a second open position spaced from the first clasp member. A spring is provided to bias the solid stem and second clasp member to the first closed position. In one embodiment, the retainer assembly is connected to the adapter base by a ball joint connection to adjust the position of the smart watch for the convenience of the user.

10 Claims, 7 Drawing Sheets

(56) References Cited

U.S. PATENT DOCUMENTS

| | | | | |
|---|---|---|---|---|
| 2003/0145442 | A1* | 8/2003 | Hoshino | A44C 5/2061<br>24/663 |
| 2009/0013721 | A1* | 1/2009 | Murao | A44C 5/2038<br>63/3.1 |
| 2012/0279026 | A1* | 11/2012 | Ozkok | A44C 5/2038<br>24/457 |
| 2015/0040358 | A1* | 2/2015 | Burns | A44C 5/2014<br>24/600.5 |

* cited by examiner

NECKLACE ADAPTER FOR A WATCH

CROSS-REFERENCE TO RELATED APPLICATION

This application claims the benefit of U.S. Provisional Patent Application Ser. No. 62/131,774, filed Mar. 11, 2015, which is incorporated herein in its entirety.

FIELD OF THE INVENTION

The present invention relates generally to a retainer for a watch and, more particularly, to a detachable necklace adapter for a watch to facilitate carrying and manipulation.

BACKGROUND OF THE INVENTION

It is often important in today's society for a person to carry one or more "smart" electronic devices such as, for example, smart phones, smart watches, etc. These devices are often carried in pockets or on the user's wrist.

With particular reference to smart watches, although smart watches are provided with considerably appealing aesthetic designs, a user may wish to wear his or her conventional watch instead, and be forced to carry the smart watch in their pocket, purse or handbag When more than one device is carried, for example carrying multiple smart watches, it becomes burdensome and difficult to have both devices available for immediate use. Carrying both watches on the user's wrist(s) is awkward and keeping one of the smart watches in a pocket or purse limits the availability for immediate use.

Accordingly, there is an established need for new accessories which provide users with alternatives as to where and how to carry electronic devices, and more particularly, a smart watch, in order to benefit from the smart watch's technology while being able to wear a conventional watch on his or her wrist. In addition, the user would also benefit from being able to utilize more than one smart watch at a time without having to wear them all on his or her wrist.

SUMMARY OF THE INVENTION

The present invention is directed to a necklace adapter for connecting a portable electronic device, such as, for example, a smart watch to a lanyard, cord or necklace of a user. The invention therefore allows a user to wear a watch or a smart watch as a pendant, and thus be able to wear a conventional watch, bracelets, or other items on his or her wrist.

Introducing a first embodiment of the invention, the present invention consists of a necklace adapter for use with a portable electronic device, the necklace adapter comprising, an adapter base having a connector portion for mounting to a side channel of the device; and a retainer assembly extending from the adapter base and including a necklace-retaining clasp.

In a second aspect, the connector portion includes tapered ends.

In another aspect, the connector portion includes a locking slot engagable with a locking protrusion or projection on a portable electronic device.

In another aspect, the adapter base includes a mounting portion.

In another aspect, the mounting portion extends from the connector portion.

In another aspect, the retainer assembly is movably mounted to the connector portion.

In another aspect, the retainer assembly is movably mounted to the adapter base by a ball joint connection.

In another aspect, the necklace-retaining clasp is movable from a first, closed position and a second, open position.

In another aspect, the retainer assembly includes a lower unit attached to the adapter base and having a downwardly facing top clasp member, and an upper unit having an upwardly facing bottom clasp member, the upper unit being movably mounted to the lower unit wherein the top and bottom clasp members are relatively movable from a first closed position substantially adjacent each other to a second open position such that the top clasp member and bottom clasp member are spaced apart.

In another aspect, the lower unit of the retainer assembly is movably mounted to the adapter base by a ball joint connection.

In a further aspect, the lower unit includes a hollow stem and the upper unit includes a shaft, the shaft of the upper unit being movably mounted within the hollow stem of the lower unit.

In another aspect, the top and bottom clasp members are biased to the first closed position.

In another aspect, the top and bottom clasp members are biased to the first closed position by a spring positioned within the hollow stem.

In a further aspect, the upper unit includes a top free end for a user to push, and cause the upper unit to move relative to the lower unit.

In another aspect, the top free end comprises an enlarged sphere.

Further, disclosed is a necklace adapter for releasably retaining a portable electronic device, said necklace adaptor comprising, an adapter base including a connector portion for removably mounting the adapter base to a side channel of the portable electronic device; and a retainer assembly extending from the adapter base, the retainer assembly including, a bottom clasp member, a top clasp member, and a control member, the control member displaceable from a first position to a second position to increase a separation between tips of the clasp members.

In another aspect, the portable electronic device is a smart watch.

In another aspect, the separation in the second position is large enough for a thickness of a necklace to pass through.

In another aspect, the control member is spring biased to the first position.

In another aspect, the necklace adapter further comprises a spring disposed within the retainer assembly to bias the control member to the first position.

In another aspect, the control member and the bottom clasp member are attached such that displacing the control member causes the bottom clasp member to rotate and increase the separation between the tips of the clasp members.

In another aspect, the adapter base is pivotably attached to the retainer assembly.

In another aspect, the clasp members each have a curved shape.

In another aspect, the first position causes the clasp members to form a circular clasp.

Furthermore, disclosed is a necklace adapter for releasably retaining a portable electronic device, said necklace adaptor comprising, an adapter base including a connector portion for removably mounting the adapter base to a side channel of the portable electronic device, a lower unit attached to a top of the adapter base, from which a bottom clasp member extends upwardly to a lower terminal tip, an upper unit attached to the lower unit, from which a top clasp member extends downwardly to an upper terminal tip; and a control member displaceably secured to the upper unit, the control member mechanically attached to selectively displace the bottom clasp member between a closed clasp position and an open clasp position, the control member being forcedly biased to the closed clasp position, and the upper unit and the lower unit being adjacent such that the bottom clasp member and the top clasp member form a retention clasp in the closed clasp position.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

The invention is directed to a necklace adapter for connecting a portable electronic device, such as a smart watch (an example being, but not limited to, an Apple Watch), to a lanyard, cord, or necklace of a user. The invention therefore allows a user to wear a watch or a smart watch as a pendant, and thus be able to wear a conventional watch, bracelets, or other items on their wrist. Additionally, it provides a convent means of individuals with disabilities that either do not have the use of both arms or have lost one to utilize all the convivences of an Apple Watch.

Figure 1:
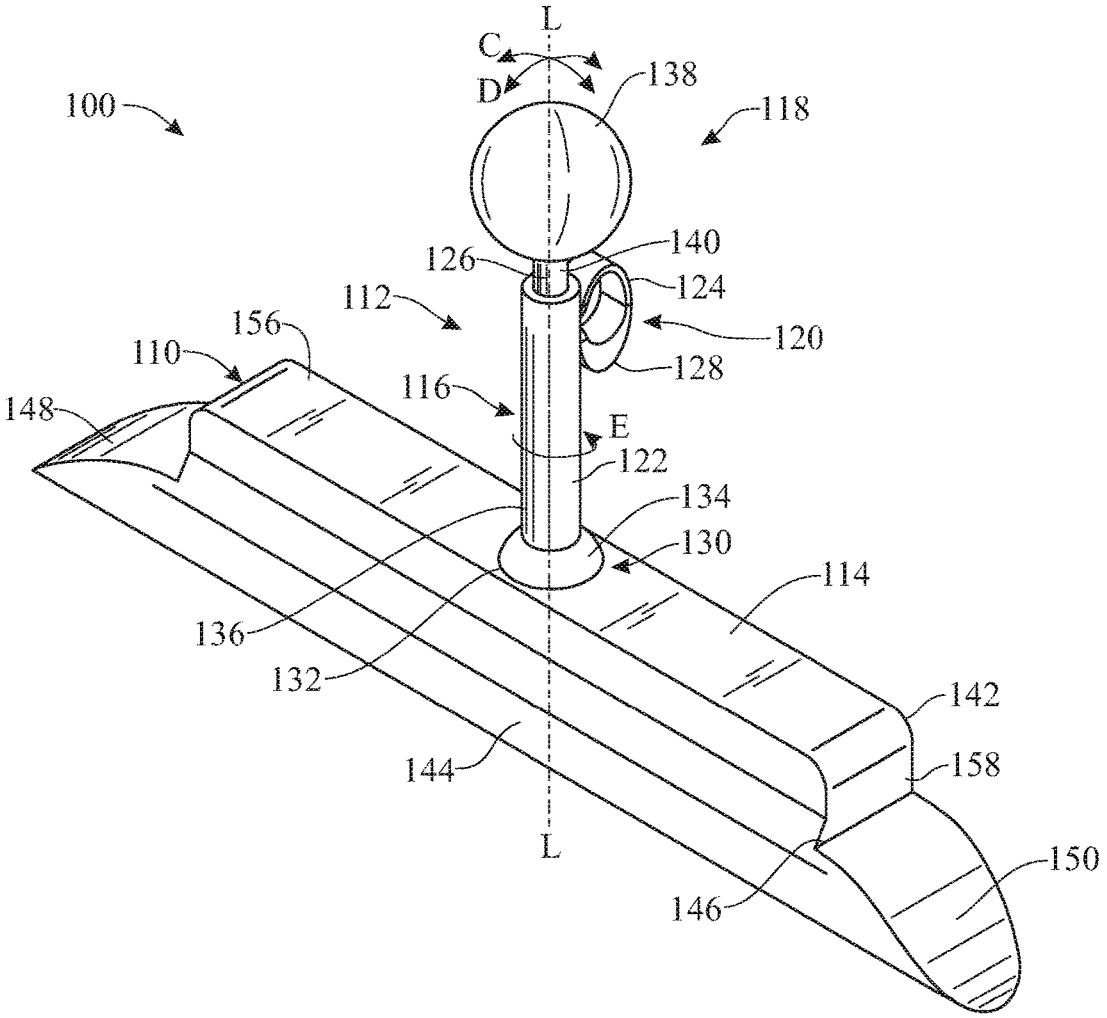
FIG. 1 presents an isometric top front view of an exemplary embodiment of a necklace adapter for a watch in accordance with the invention.
Figure 2:
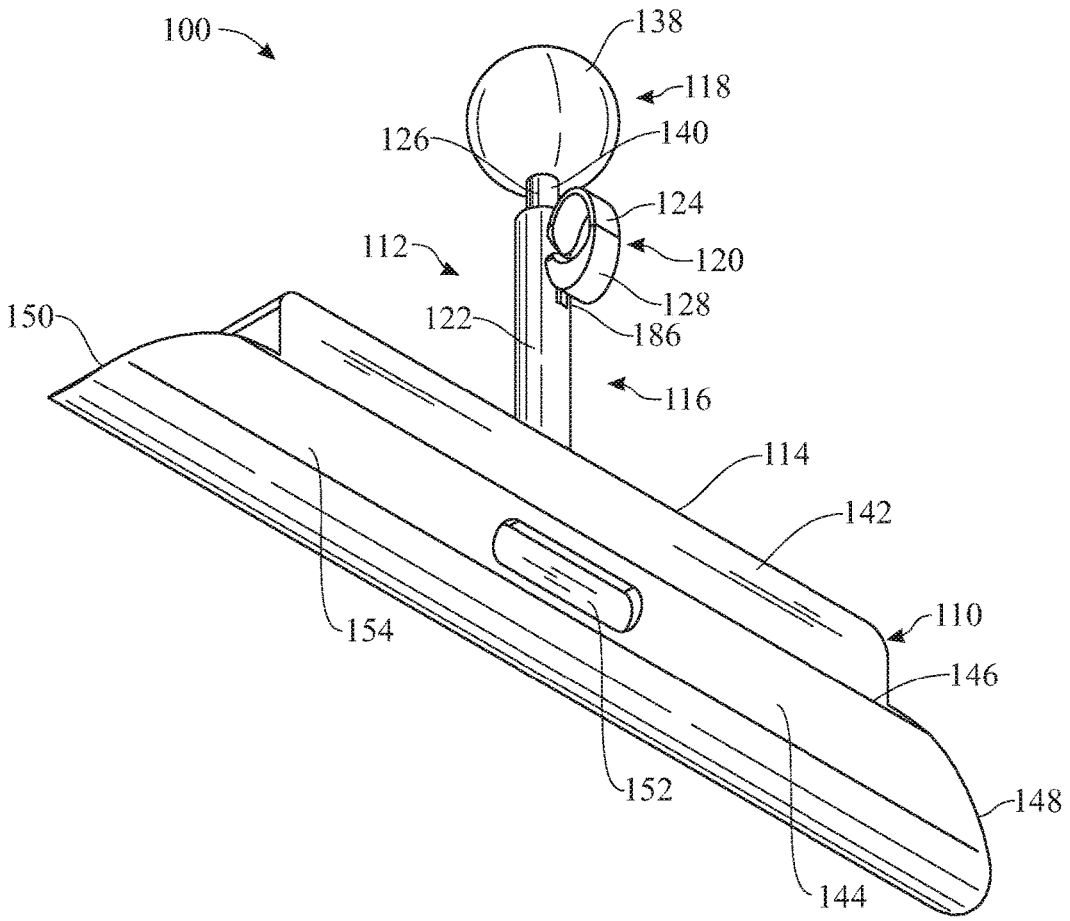
FIG. 2 presents an isometric bottom rear view of the necklace adapter of FIG. 1.

Referring to FIGS. 1 through 5, and initially to FIGS. 1 and 2, there is disclosed a necklace adapter 100 for use in releasably retaining a smart watch or other device about a neck of a user. The necklace adapter 100 generally includes an adapter base 110 and a retainer assembly 112 extending from an upper surface 114 of the adapter base 110. The adapter base 110 is configured to attach to a watch such as, but not limited to, a smart watch, while the retainer assembly 112 is configured to releasably retain a neck cord or necklace of a user.

The retainer assembly 112 includes a lower unit 116, extending from the upper surface 114 of the adapter base 110, and an upper unit 118 movably mounted to the lower unit 116. The upper unit 118 and the lower unit 116 together form a retention clasp 120 for releasable receipt of a neck cord or necklace. The lower unit 116 generally includes a hollow stem 122 having a first or downwardly facing top clasp member 124 extending from an outer surface 126 of the hollow stem 122 and the upper unit 118 generally includes a solid shaft 126 movable within the hollow stem 122 and having a second or upwardly facing bottom clasp member 128. When the solid shaft 126 of the upper unit 118 is moved downwardly within the hollow stem 122 of lower unit 116, the top clasp member 124 and the bottom clasp member 128 together form the retention clasp 120. It is to be understood that the clasp members described herein may take form in a hook shape or a hook. Further, the herein described clasp may take form as a ring shape or ring. For example, the first position causes or forces the clasp members to form a circular clasp.

The adapter base 110, the lower unit 116 and the upper unit 118 may be formed from a variety of materials, such as, for example metallic materials, polymeric materials, etc. When formed from a metallic material, the above-referenced components may be coated or highly polished to compliment the necklace or other jewelry of a user or when formed from a polymeric material may be shaped and/or colored to compliment the smart device being used therewith. The lower unit 116 and/or the upper unit 118 may optionally be decorated with colors, textures, stones or gems, or any suitable decorative addition or combination thereof. Alternatively or additionally, various logos, markings or indicia may be provided on the disclosed components.

In the present exemplary embodiment, the retainer assembly 112 is movably mounted to the adapter base 110 and has a wide range of movement relative to adapter base 110.

Specifically, the lower unit 116 is movably connected to the top surface 114 of the adapter base 110 by a ball joint connection 130 which allows the retainer assembly 112 to swivel and pivot relative to the adapter base 110 in the directions of arrows C and D. The ball joint connection 130 also allows the retainer assembly 112 to rotate about a long axis L-L (FIG. 1) of the retainer assembly 112 in the direction of arrow E and relative to the adapter base 110. The retainer assembly 112 may also pivot in an opposite direction of arrow E. This range of movement allows the user to easily position the attached smart watch for convenient use.

Figure 3:
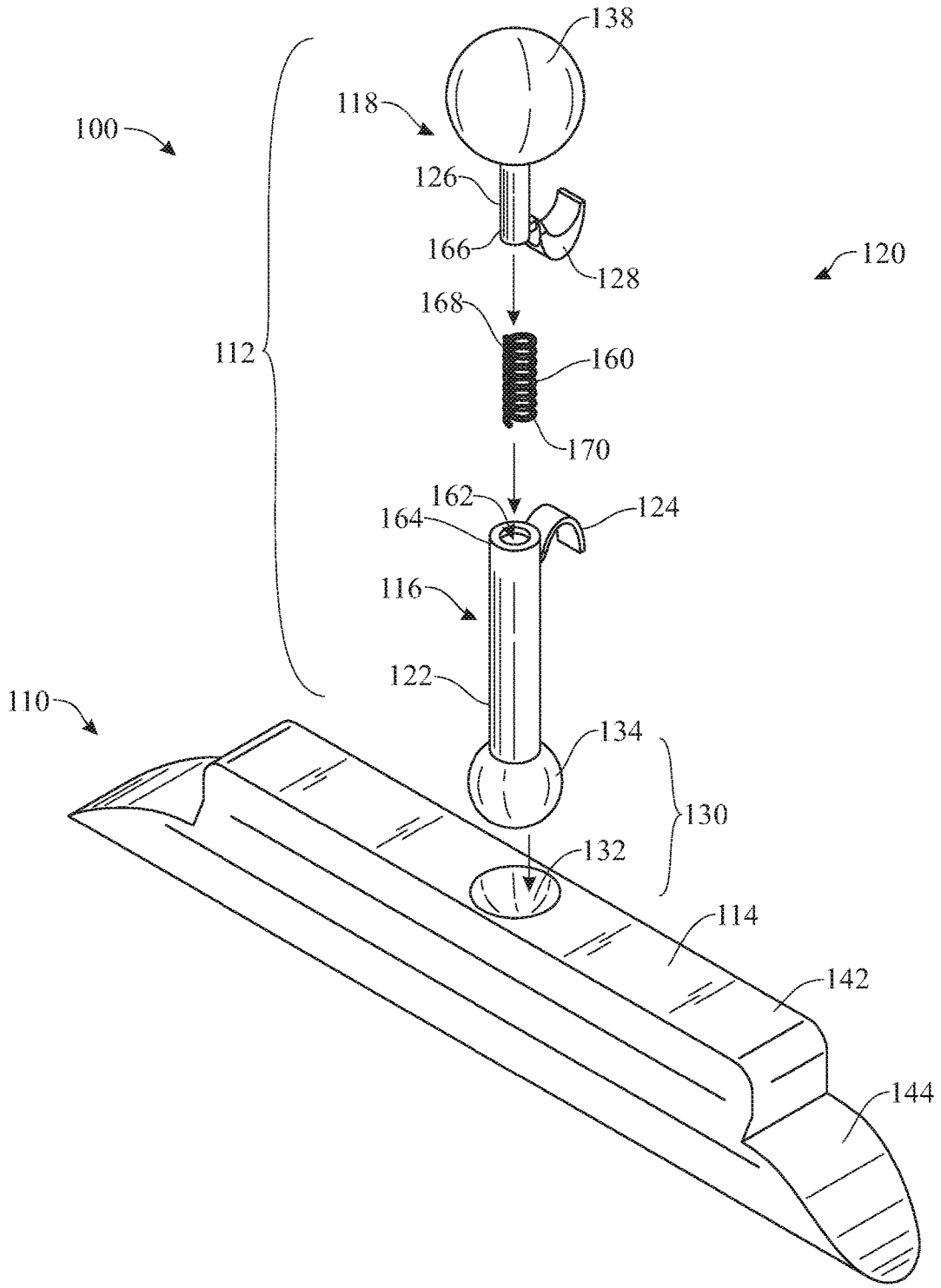
FIG. 3 presents an isometric top front view, with parts separated, of the necklace adapter of FIG. 1.

As best shown in FIG. 3, the hall joint connection 130 includes a hollow, spherical depression 132 formed in the top surface 114 of the adapter base 110 and a smooth ball 134 provided on a first end 136 of the hollow stem 122. The smooth ball 134 is movably retained within the spherical depression 132 by a press or snap in fit connection to prevent the retainer assembly 112 from separating from the adapter base 110. This connection may be tight and friction fit such that any adjustment of the retainer assembly 112 relative to the adapter base 110 is retained until further moved. The smooth ball 134 may be attached to the hollow stem 122 using known methods or may be intragrally formed with the hollow stem 122. In order to move the retainer assembly 112 relative to the adapter base 110, as well as move the upper unit 118 within the lower unit 116, the solid shaft 126 of the upper unit 118 has a control member or sphere 138 provided on a first end 140 of the solid shaft 126. The control member may take any appropriate shape for being displaced manually or by a user's finger. For example, the control member may be displaced vertically or in some embodiments laterally to cause the clasp members to separate from one another (i.e. causing a gap or separation to form between the tips of the clasp members to receive a necklace). For example, the gap may be large enough to receive a necklace band thickness to receive the necklace band. For example, the gap or separation may be large enough for a thickness of a necklace to pass through the control member may be a sphere or may be a straight or curved bar (a curved shape), and may be configured to displace or rotate one or both of the clasp members (e.g. top clasp member or bottom clasp member). In some embodiments, the necklace adapter is provided with a necklace in a kit.

As noted above, the adapter base 110 is provided for releasable attachment to a smart watch or other device. The adapter base 110 includes a mounting portion or generally rectangular upper platform 142, including the top surface 114, and a connector portion or semi-cylindrical lower platform 144 for insertion into a corresponding channel in a smart watch as described in more detail hereinbelow. The upper platform 142 is affixed to or extends from a relatively flat top surface 146 of the lower platform 144. The lower platform 144 can have tapered first and second ends 148 and 150 to facilitate insertion of the adapter base 110 into the corresponding channel of the smart watch. A longitudinal slot 152 (FIG. 2) is provided in an outer surface 154 of the lower platform 144 of the present embodiment, generally located directly below the spherical depression 132 in the upper platform 142, and functions as a part of a locking device for retaining the necklace adapter 100 in a smart watch. As shown in FIG. 1, the first and second ends 156 and 158, respectively, of the upper platform 142 are longitudinally inward of the first and second ends 148 and 150 of the lower platform 144 such that the upper platform 142 is shorter than the lower platform 144 for functional and aesthetic purposes.

Figure 4:
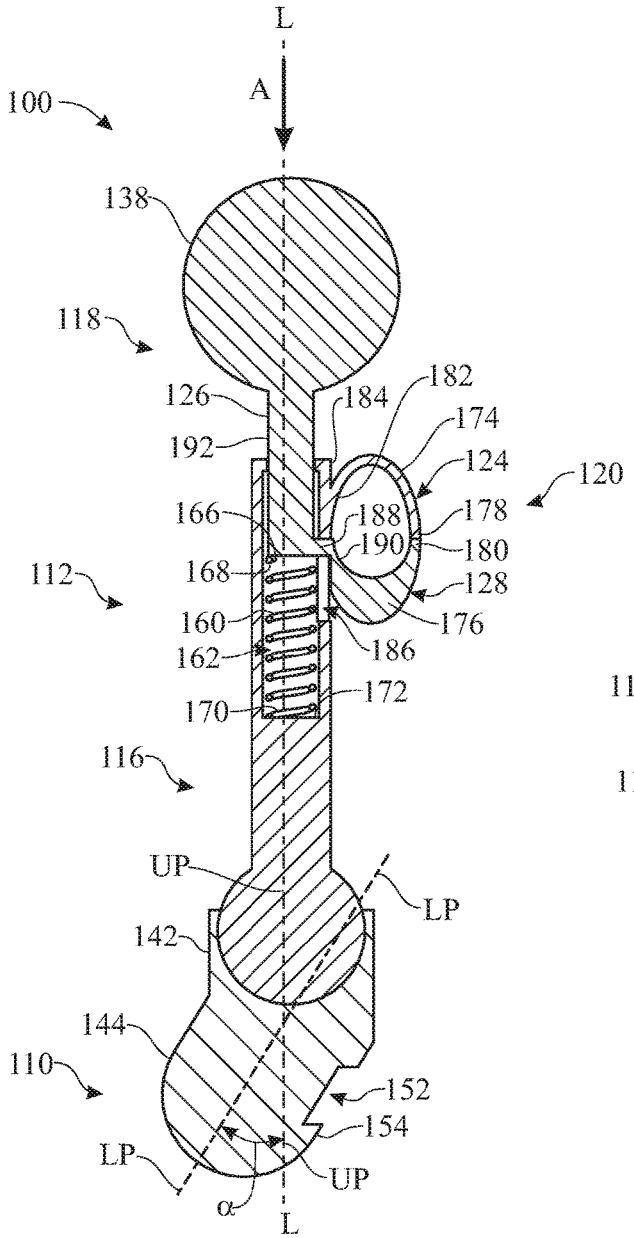
FIG. 4 presents a cross-sectional side elevation view of the necklace adapter of FIG. 1 with a clasp member in a first, closed position.
Figure 5:
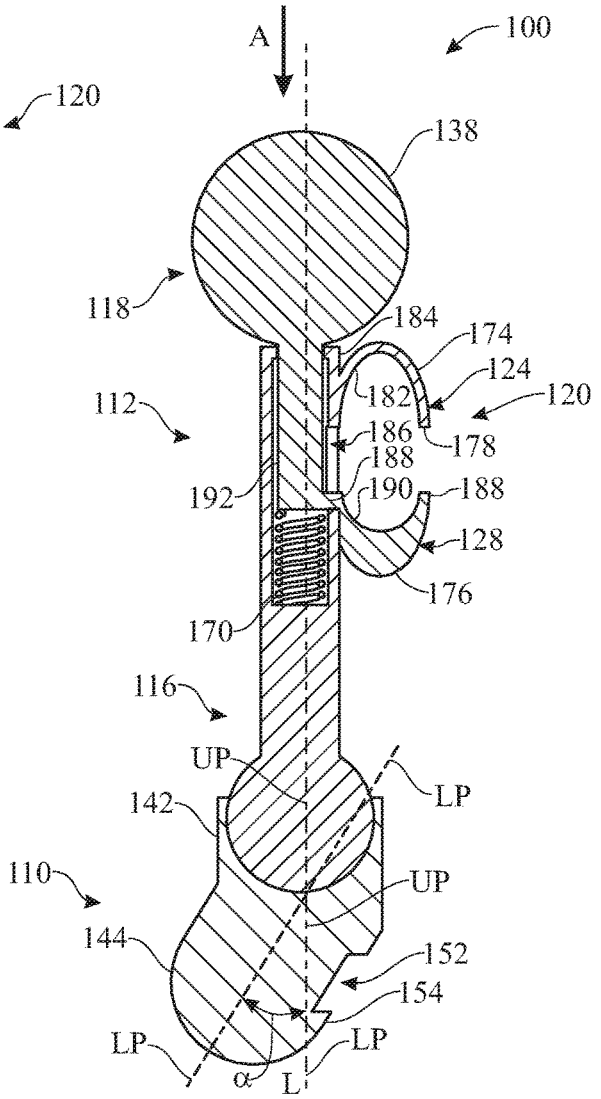
FIG. 5 presents a cross-sectional side elevation view of the necklace adapter of FIG. 1 with the clasp member in a second, open position.

With reference to FIGS. 3 through 5, the solid shaft 126 slides relative to the hollow stem 122 to move the bottom clasp member 128 relative to the top clasp member 124 to open and close the retention clasp 120 about a cord or necklace. In order to bias (e.g. spring bias) the retention clasp 120 to a closed position (e.g. first position), with the top and bottom clasp members 124 and 128, respectively, touching each other (FIG. 4), the retainer assembly 112 includes a spring 160. The spring 160 of the present embodiment is a coil compression spring that is disposed within a hollow bore 162 formed through a second end 164 of the hollow stem 122 and is engaged by a second end 166 of the solid shaft 126. Specifically, a first end 168 of the spring 160 abuts the second end 166 of the solid shaft 126 while a second end 170 of the spring 160 abuts a bottom or base 172 (FIGS. 4 and 5) in the hollow bore 162 of the hollow stem 122. As such, in an assembled state, the solid shaft 126 is disposed within the hollow stem 122 such that the bottom clasp member 128 lies beneath the top clasp member 124, and the tips of the clasp members are adjacently disposed or in contact. In the assembled state, the top clasp member 124 and the bottom clasp member 128 are forcedly biased toward one another via the spring 160 exerting a force on the solid shaft 126 and the hollow stem 122. For example, the bias may be configured to force or separate the solid shaft 124 away (upward in FIG. 3) from the hollow stem 122. The spring may be disposed within the upper unit to bias the control member to the closed clasp position, the spring configured to follow Hooke's law, $F=kX$ where k is a spring constant, F is force, and X is displacement of an end of the spring.

As best shown in FIGS. 4 and 5, the top and bottom clasp members 124 and 128 have arcuate or semi-circular shaped body portions 174 and 176 and terminate in respective free ends or tips 178 and 180. A connecting end 182 of the body portion 174 top clasp member 124 is affixed to, or integrally formed on, an outer surface 184 of the hollow stem 122 at the second end 164.

In order to move the bottom clasp member 128 of the upper unit 118 (which is outside the hollow stem 122) relative to the top clasp member 124 of the lower unit 116 in response to movement of the solid shaft 126 (which is inside the hollow stem 122), the hollow stem 122 includes a longitudinal slot 186 which extends from the outer surface 184 of the hollow stem 122 to the bore 162 of the hollow stem 122. The longitudinal slot 186 may take any appropriate shape, such as an "L" shape, in embodiments where the bottom clasp member 126 and the solid shaft 122 are integral, such that the solid shaft 126 may be inserted downward into the hollow stem 122 and rotated to bring the bottom clasp member 126 and the top clasp member 124 into alignment as shown in FIG. 2. For example, the longitudinal slot 186 may have a first vertical portion disposed toward a top end of the hollow stem 122, a horizontal portion extending laterally relative to the vertical portion, and a second vertical portion where the clasp members become aligned as shown in FIG. 2. A short shaft or bar 188 is provided on the upper unit 118 and connects a connecting end 190 of the bottom clasp member 128 to an outer surface 192 of the solid shaft 126. The short bar 188 rides in and passes through the longitudinal slot 186 in the hollow stem 122. As such, the lower unit may be attached to a top of the adapter base, from which the bottom clasp member extends upwardly to a lower terminal tip. The upper unit may be attached to the lower unit, from which a top clasp member extends downwardly to an upper terminal tip. Further, the control member may be displaceably secured to the upper unit, the control member mechanically attached to selectively displace the bottom clasp member between the closed clasp position and the open clasp position. The upper unit and the lower unit may be adjacent such that the bottom clasp member and the top clasp member form a retention clasp in the closed clasp position.

In operation, pressing down in the direction of arrow A (FIGS. 4 and 5) moves the solid shaft 126 downward with the hollow bore 162 of the hollow shaft 122 and against the bias of spring 160. This moves the top and bottom clasp members 124 and 128, respectively, from the first closed position (FIG. 4) wherein the end tips 178 and 180 of the top and bottom clasp members 124 and 128 are in close or full contact to a second open position (e.g. open position) (FIG. 5) wherein the end tips 178 and 180 are spaced apart. In the second, open position, the retention clasp 120 can receive a cord or necklace. In the first, closed position, the retention clasp 120 can retain the cord or necklace. As such, the control member and the bottom clasp member are attached such that displacing the control member causes the bottom member to rotate and increase the separation between the tips of the clasp members.

In this particular embodiment, the orientation of the lower platform 144 of the adapter base 110 is offset from the upper platform 142 for ease in insertion of the lower platform 144 into a channel in a smart watch. Specifically, a center line LP-LP of the lower platform 144 is at an angle n relative to a center line UP-UP of the upper platform 142. It should be noted that, while in FIGS. 4 and 5 the center line UP-UP of the upper platform 142 is shown as coinciding with the long axis L-L of the retainer assembly 112, since the retainer assembly 112 is movably mounted to the adapter base 110 and specifically to the upper platform 142, through the ball joint connection 130, the center line UP-UP of the upper platform 142 will move relative to the long axis L-L of the retainer assembly 112 as the retainer assembly 112 is moved relative to the adapter base 110.

Figure 6:
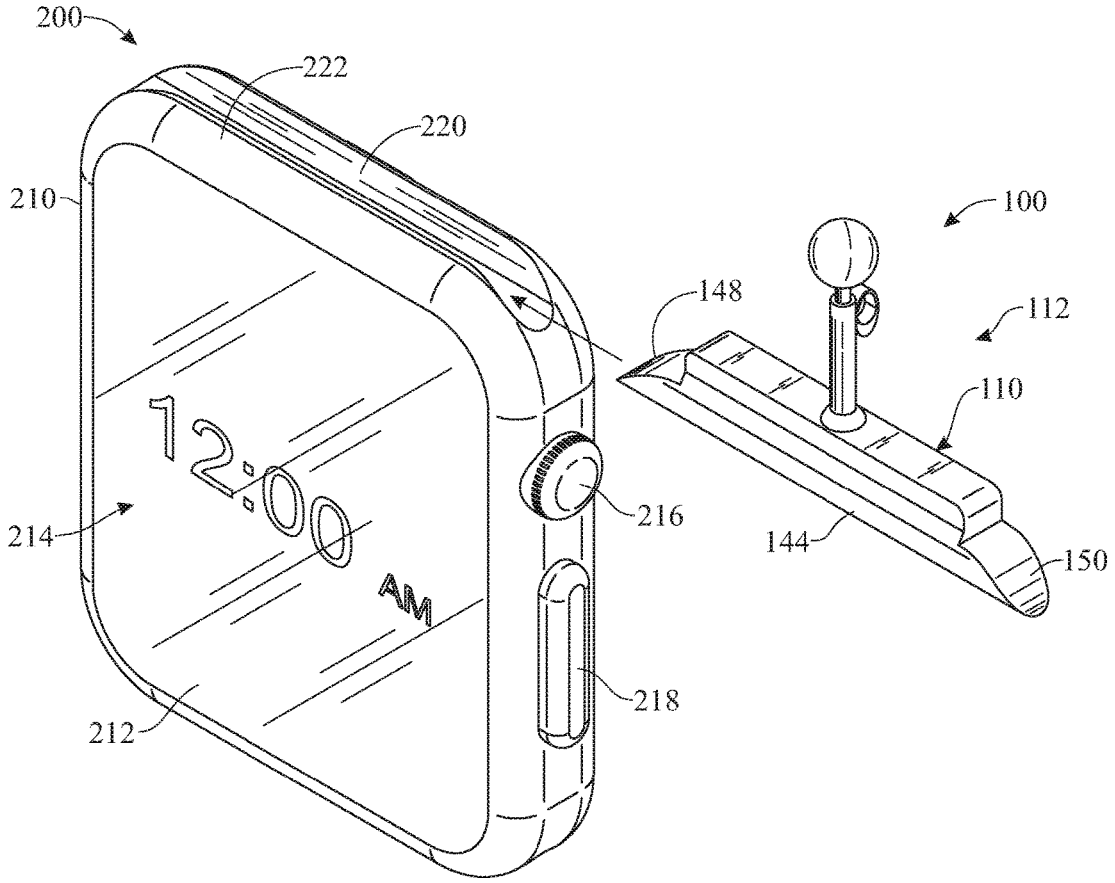
FIG. 6 presents an isometric top front view of the necklace adapter of FIG. 1 prior to insertion in a side channel of a smart watch.
Figure 7:
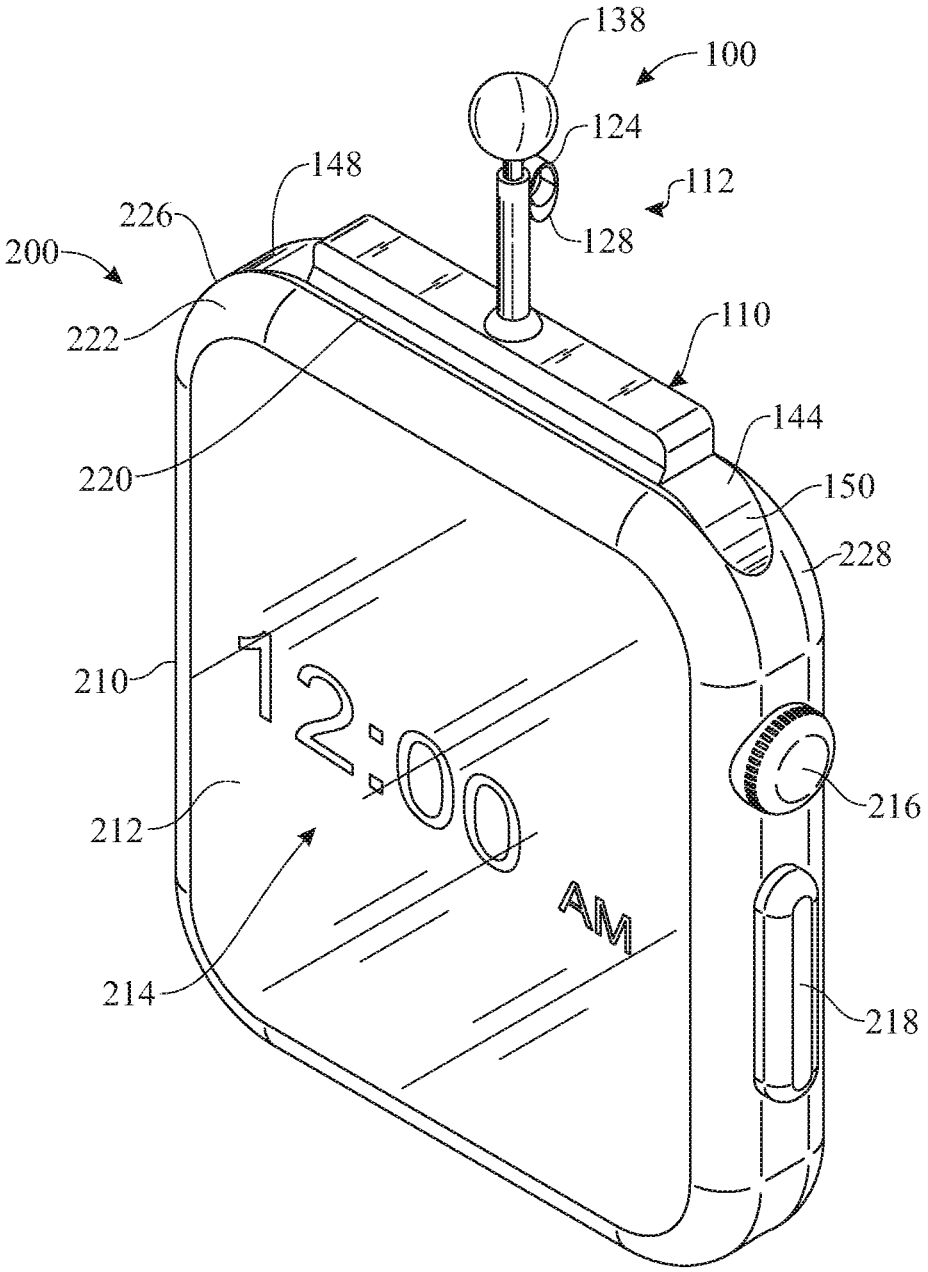
FIG. 7 presents an isometric top front view of the necklace adapter of FIG. 1 fully inserted into the side channel of the smart watch of FIG. 6.
Figure 8:
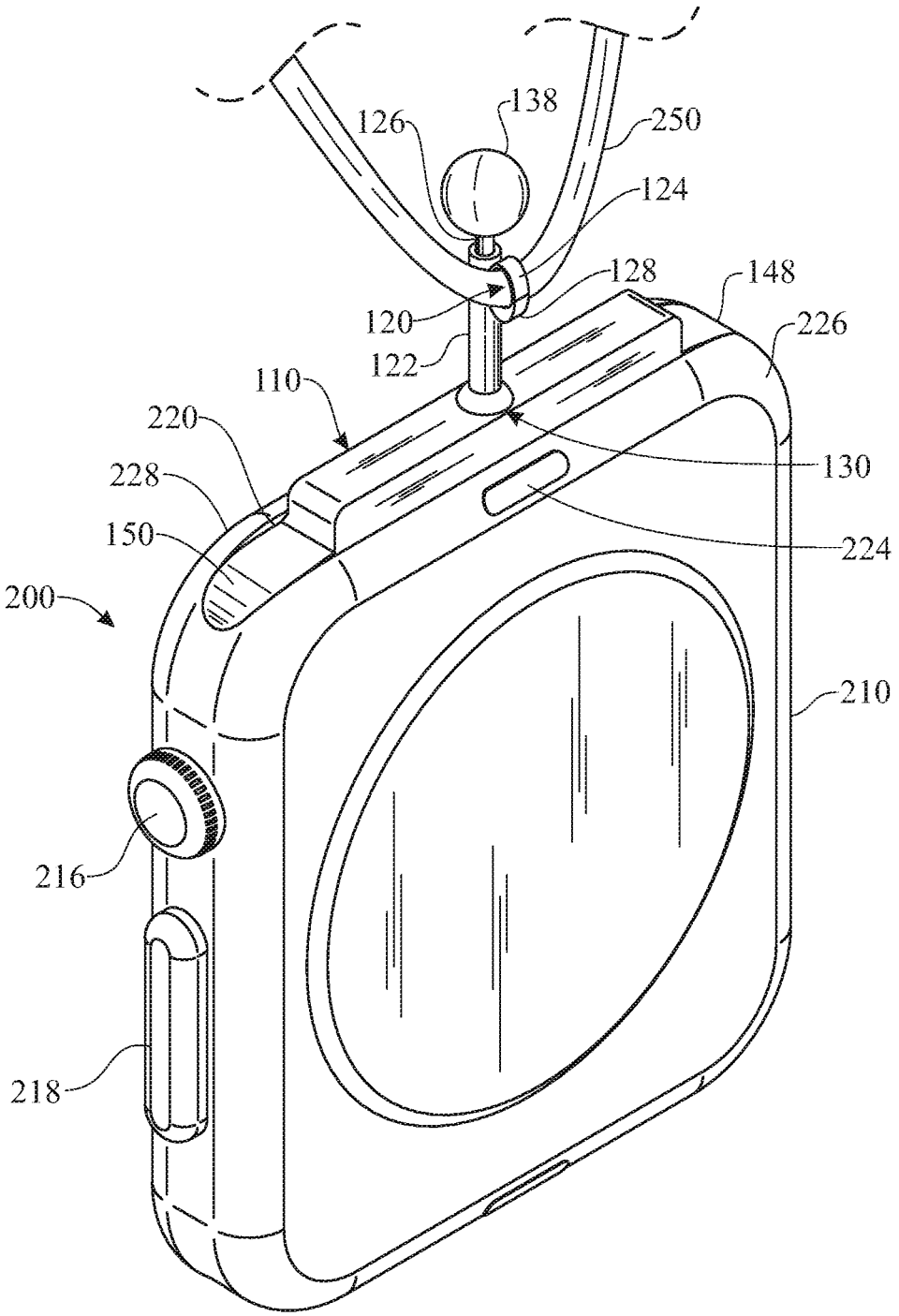
FIG. 8 presents an isometric top rear view of the necklace adapter of FIG. 1 retaining a cord in the clasp member and fully inserted and locked into the side channel of the smart watch of FIG. 6.

Referring now to FIGS. 6 through 8, and as noted above, the disclosed necklace adapter 110 is provided for use with a device such as, for example, smart watch 200. Smart watch 200 generally includes a body portion 210 having a display screen 212 for displaying information 214. Switches 216 and 218 are provided for operating the device through its various functions. Generally, the smart watches 200 include an arcuate, longitudinal channel 220 formed in an upper edge 222 of the body portion 210. The channel 220 is normally used for receipt of a lanyard or other wrist connection.

With specific reference to FIGS. 6 and 7, in use, the necklace adapter 100 is initially attached to the smart watch 200 by sliding the lower platform 144 into the longitudinal channel 220 in the smart watch 200. This secures the necklace adapter 100 to the smart watch 200 and readies it for use. As shown in FIG. 7, the tapered first and second ends 148 and 150 of the lower platform 144 conform to arcuate, upper edges 226 and 228 of the body portion 210 of the smart watch 200 to create a non-snagging surface.

Referring now to FIG. 8, it should be noted that if the smart watch 200 has a locking button 224, the locking button 224 can be activated to fixedly engage the smart watch 200 to the necklace adapter 100. This is accomplished by providing a bar or other protrusion (not shown) on the smart watch 200 which, when activated, extends into the longitudinal channel 220 of the smart watch 200. The protrusion will extend into the longitudinal slot 152 (FIG. 2) on the lower platform 144 of the necklace adapter 100 and fixedly and releasably secure the lower platform 144 within the longitudinal channel 220 of the smart watch. Reactivation of the locking button 224 will withdraw the protrusion from the longitudinal slot 152 to unlock the necklace adapter 100 and free it for removal from the smart watch 200.

To attach the necklace adapter 100, before or after attachment to the smart watch 200, to a cord or necklace, such as, for example, necklace 250, the sphere 183 is pressed down to move retention clasp 120 to the open position as specifically described in detail hereinabove. The bottom clasp member 128 is moved down and away from the top clasp member 124, against the bias of the spring 160 (FIG. 5) for receipt of the necklace 250. Once the necklace 250 has been positioned between the top and bottom clasp members 128 and 124, respectively, pressure is release from the sphere 138 allowing the spring 160 to bias the solid shaft 126 up relative to the hollow stem 122 and move the retention clasp 120 back to the closed condition about the necklace 250.

Thus, in this manner, the disclosed necklace adapter 100 provides a simple and useful system and method of attaching the smart watch 200 to the necklace 250 worn around the neck of a user. The ball joint connection 130 of the necklace adapter 100 allows the user to pivot the smart watch 200 relative to the necklace 250 and/or the chest of the user to facilitate viewing and use of the smart watch 200. This allows and frees up the user to have other smart watches on the wrist, as well as keeping the smart watch 200 available for immediate use.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

I claim:

1. A necklace adapter for releasably retaining a portable electronic device, said necklace adapter comprising:

an adapter base, a retainer assembly extending from an upper surface of the adapter base;

said retainer assembly, releasably connected to a necklace;

said retainer assembly comprised of a lower unit, an upper unit movably mounted to the lower unit;

said lower unit having a hollow stem;

said upper unit of said retainer assembly, movably mounted within said lower unit within said hollow stem forming a bottom clasp member;

said lower unit forming a top clasp member;

a control member or sphere being in communication with said upper unit and said lower unit;

said upper unit being internally disposed in said hollow stem of said lower unit;

said upper unit being displaceable from a closed position to an open position thereby opening said clasp members;

said upper unit capable of moving with said control unit to increase the separation between said top and said bottom clasp members;

said adapter base comprising of a lower platform;

said lower platform having a tapered first end and a tapered second end;

said retainer assembly, mounted to said adapter base;

said retainer assembly, movably mounted to the adapter base;

said adapter base having an upper platform with a spherical depression mount for joining said adapter base to said retainer assembly;

said retainer assembly having a ball joint connection;

said ball joint configured to allow said retainer assembly to rotate about an axis defined by said hollow stem of said lower unit;

said adapter base having a semi-cylindrical lower platform configured to attach to a portable electronic device;

said lower platform fitting into a longitudinal channel of the said portable electronic device.

2. The necklace adapter of claim 1, where the control member or sphere and the bottom clasp member are attached such that displacing the control member or sphere causes the said bottom clasp member to move and increase a separation between the tips of the said top and said bottom clasp members.

3. The necklace adapter of claim 1, further comprising a spring disposed within the upper unit to bias the control member or sphere to the closed position and the spring configured to follow Hooke's law.

4. The necklace adapter of claim 1, wherein said first position of said control member or sphere does not allow said necklace to pass between the said first bottom clasp and said top clasp member.

5. The necklace adapter of claim 1, wherein said retainer assembly is in said first position does not allow said necklace to pass between the said first bottom clasp and said top clasp member.

6. The necklace adapter of claim 1, wherein said retainer assembly in said second position allows said necklace to pass through the said bottom clasp member and said top clasp member.

7. The necklace adapter of claim 1, wherein the portable electronic device is a smart watch.

8. The necklace adapter of claim 1, wherein said control member is in communication with a spring.

9. The necklace adapter of claim 1, wherein the control member nominal position is said closed position.

10. The necklace adapter of claim 1, having said lower platform wherein said lower platform is removably insertable into said channel in said portable electronic device.

* * * * *